US007856917B2

(12) United States Patent
Noveske

(10) Patent No.: US 7,856,917 B2
(45) Date of Patent: Dec. 28, 2010

(54) SWITCHBLOCK

(76) Inventor: John Noveske, 594 NE. E. St. "REAR", Grants Pass, OR (US) 97526

( * ) Notice: Subject to any disclaimer, the term of this patent is extended or adjusted under 35 U.S.C. 154(b) by 291 days.

(21) Appl. No.: 12/215,002

(22) Filed: Jun. 24, 2008

(65) Prior Publication Data

US 2010/0275770 A1 Nov. 4, 2010

Related U.S. Application Data

(60) Provisional application No. 61/063,289, filed on Jan. 31, 2008.

(51) Int. Cl.
*F41A 5/28* (2006.01)

(52) U.S. Cl. ..... 89/193

(58) Field of Classification Search ..... 89/129.01, 89/191.01, 191.02, 193
See application file for complete search history.

(56) References Cited

U.S. PATENT DOCUMENTS 2,748,662 A * 6/1956 Simpson ..... 89/193
2,845,008 A 4/1957 Atwood, Jr.
3,333,509 A 8/1967 Muhlemann
3,988,964 A * 11/1976 Moore ..... 89/185
4,433,611 A * 2/1984 Baumann ..... 89/193
5,945,626 A 8/1999 Robbins
2006/0065112 A1 * 3/2006 Kuczynko et al. ..... 89/193

* cited by examiner

*Primary Examiner*—Bret Hayes
(74) *Attorney, Agent, or Firm*—Bennet K. Langlotz; Langlotz Patent & Trademark Works, Inc.

(57) ABSTRACT

An adjustable gas block designed to interface with an autoloading firearms gas system. Three positions of adjustment are provided to optimize the gas flow from the barrel for the host firearm. One of the three provided positions of adjustment is selected if a silencer is in use, not in use, or if the user desires to stop the autoloading function of the firearm entirely. This design works by restricting the flow of gas from the gas port in the barrel and does not vent excess gas into the atmosphere around the gas block.

14 Claims, 5 Drawing Sheets

SWITCHBLOCK

CROSS-REFERENCED TO RELATED APPLICATIONS

This application claims the benefit of PPA Ser. No. 61/063,289, filed Jan. 31, 2008 by the present inventor.

BACKGROUND OF THE INVENTION

1. Field of Invention

This invention generally relates to self loading firearms, specifically to gas blocks for self loading firearms which facilitate user adjustment of the gas output. The Switchblock is designed to regulate the flow of propellant gasses which are used to cycle the self loading mechanism of the firearm. The preferred embodiment of the invention is for use with an AR15/M16 type rifle but this should not be seen as a limitation on the technologies application to other firearms.

2. Prior Art

Adjustable gas blocks have been used on autoloading rifles since WWII. Rifles such as the Soviet SVD, Yugoslavia's M76, Belgium's FAL, AR10 SASS rifle, and the recent Belgium SCAR rifles all incorporate adjustable gas blocks. What has changed is the purpose behind the incorporation of an adjustable gas block.

Gas blocks for autoloading firearms have traditionally been used as a means to collect, restrict, and direct the flow of gas from the firearm barrel and into the autoloading rifle's gas system. Early adjustable gas blocks were an attempt to minimize the wear of the host firearm by placing the minimal amount of gas necessary to properly operate the firearm into the operating system. Another common reason was for rifle mounted grenades, which required special cartridges to fire properly.

Modern adjustable gas block designs such as are present on the ArmaLite AR10 SASS and SCAR rifles are utilizing adjustable gas blocks as a means to restrict the increased flow of gas to the operating system which is the result of using a silencer.

Silencers increase the amount of gas forced through the gas system by a phenomenon known as back pressure. The addition of more gas into the operating system causes increased fouling of the weapon mechanical components, a variety of operation related malfunctions, and place unnecessary wear on the firearms internal components.

In the past designs such as the Belgium FAL have incorporated gas blocks which offer multiple settings whereby the amount of gas directed into the firearm is variable by toggling a switch. The flow of gas allowed to pass from the barrel into the operating system was either on or off. This design also has a threadedly secured nut which partially blocked a gas port on the gas system which could be actuated to further increase or decrease the flow of gas. The intent of this design was to allow the user to regulate the amount of gas allowed into the operating system based on ammunition used and barrel length.

Systems such as this present several problems. The FAL gas blocks' primary method of regulating gas flow is by venting gas into the atmosphere above the gas system. When combusting powder hits the oxygen rich environment it creates flash and noise. This precludes such a system from use with a silencer because flash and noise reduction are the primary functions of a silencer. Another disadvantage is the difficulty of adjustment. Adjusting the gas flow requires a wrench and offers a variety of settings none of which are pre set. This makes the system impractical for field expedient adjustments.

Other designs such as the ArmaLite AR10 gas block offer the user an ability to regulate the flow of gas by toggling a screw which occludes the port which allows gas to flow into the gas block and subsequently into the gas system. This system was purposed designed for use with a silencer and offer two positions of operation. Standard gas flow and a reduced gas flow are the only two options afforded the user.

Design such as present on ArmaLite's AR10 SASS rifle only offer two adjustments position, one which is standard flow another which is a reduced flow. Further, no provision to prevent gases from escaping from the gas block and generating flash and sound are provided for.

The present invention offers several advantages over the prior art. Three positions of adjustment are afforded the user. Standard gas flow, reduced gas flow, and no gas flow. The no gas flow allows the user to stop the autoloading capability of the host firearm and to maximize both the accuracy of the firearm and the sound reduction capability of the silencer. A spring loaded detent is utilized to hold the gas regulator knob in each position and allows for quick, field expedient adjustment. This system works by restricting the flow of gas from the host firearm barrels gas port, and not by venting the excess gas into the atmosphere. Further, gas rings are utilized within the housing to prevent the pressurized gases from escaping. The amount of gas necessary to operate the rifle on both the standard and reduced gas flow settings is determined at the factory based on the caliber, barrel length, and gas system length of the host firearm. When a gas block, which embodies the present invention, is installed a gas tube is also incorporated which has apertures that determine the amount of gas allowed to pass into the operating system.

BACKGROUND OF INVENTION

Objects and Advantages

Accordingly several objects and advantages of the present invention are (a) To provide the users three gas settings for the host rifle which are a standard gas flow, reduced gas flow and no gas flow (b) To provide a device which allows for easy, field expedite manipulation by the user without the need for special tools (c) To provide a means to restrict the flow of gas allowed into the operating system without venting excess gas into the atmosphere.

Still further objects and advantages will become apparent from a consideration of the ensuing description and drawings.

SUMMARY

In accordance with one embodiment of the present invention, a firearm is provided comprising a receiver, a barrel, a gas block and a gas tube. The barrel is connected to a front end of the receiver. The Switchblock is secured to the barrel by two set screws. The gas tube extends from the gas block into the receiver. The Switchblock has a spring loaded adjustment lever which when depressed allows for the rotation of an adjustment knob. By rotating the adjustment knob the user may restrict or increase the gas flow based on one of three provided positions of use. The three positions of use provide a standard gas flow as optimized for the host firearm, a reduced gas flow optimized for the host firearms use with a silencer, and finally a position which completely shuts off gas flow so that optimal sound reduction is achieved.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

The Switchblock is designed to offer the user of an AR15 or AR10 style rifle the option of adjusting the amount of gas which is allowed to pass from the bore of the host firearm into the gas operating system. Please note that the essential features of the herein described design as not limited to the above mentioned gas operating systems.

Figure 1:
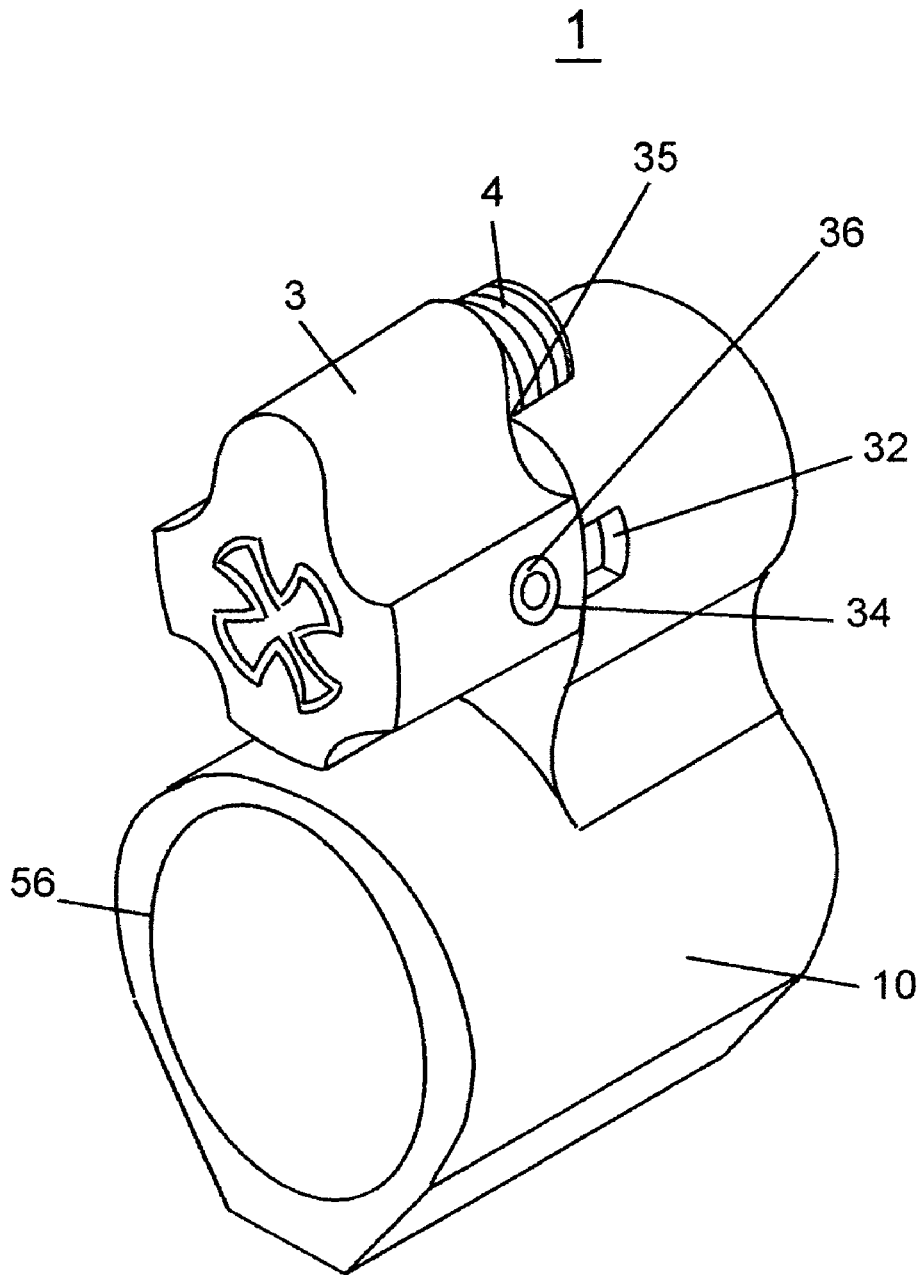
FIG. 1 is a side view of a Switchblock gas block assembled.
Figure 2:
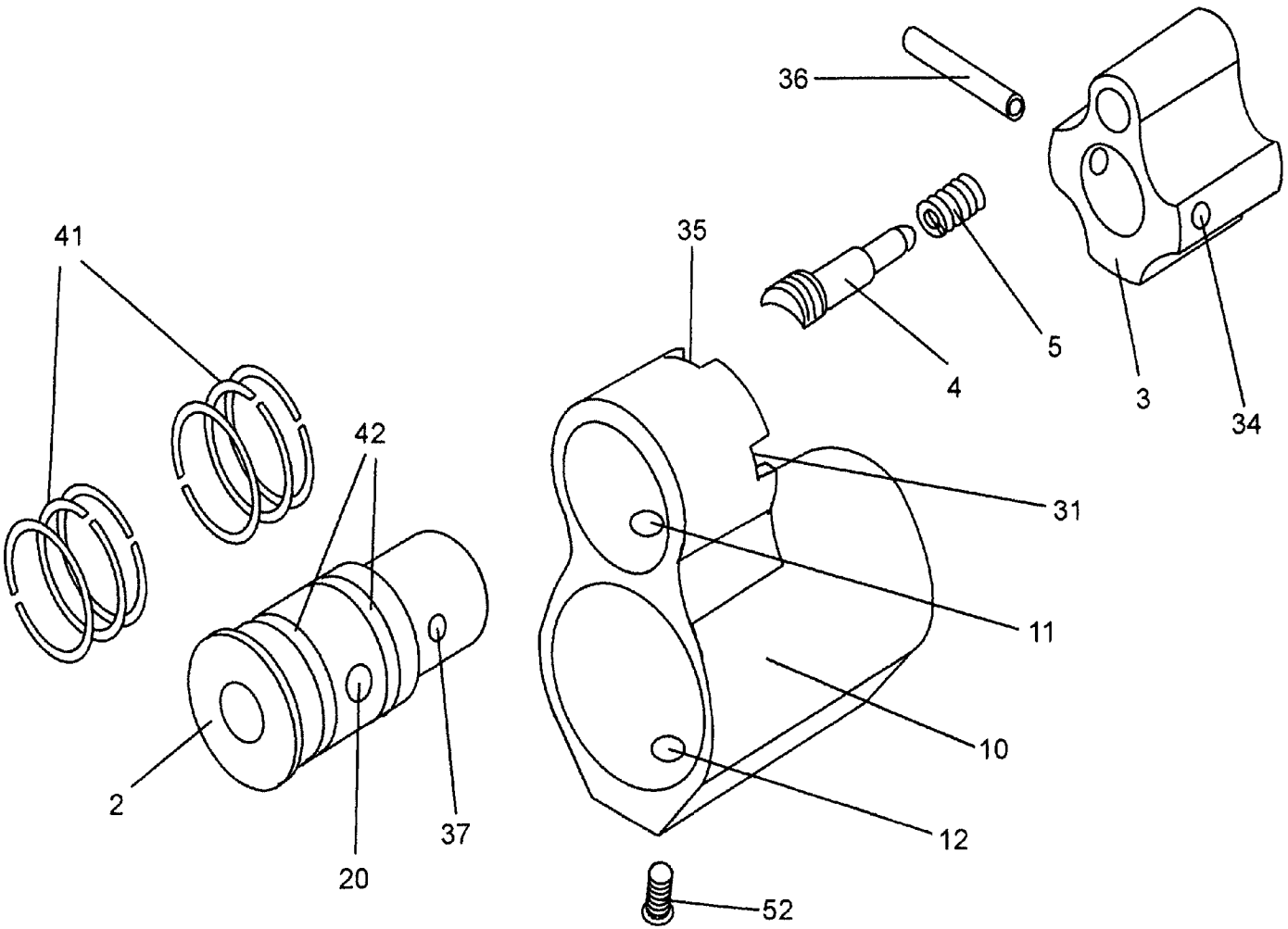
FIG. 2 is an exploded view thereof.

Turning now to the drawings in which like reference characters indicate corresponding elements throughout the several views, attention is directed to FIGS. 1 & 2 which illustrates the preferred embodiment of the herein proposed invention. The proposed Switchblock 1 is a replacement for a standard gas block, well known in the prior art, for an autoloading firearm 50, shown in FIG. 6. The Switchblock 1 consist of a housing 10, adjustment knob 3, adjustment detent 4, drum 2 and a roll pin retention point 34. At the bottom of the housing 10 is a set screw retention point 12.

Figure 3:
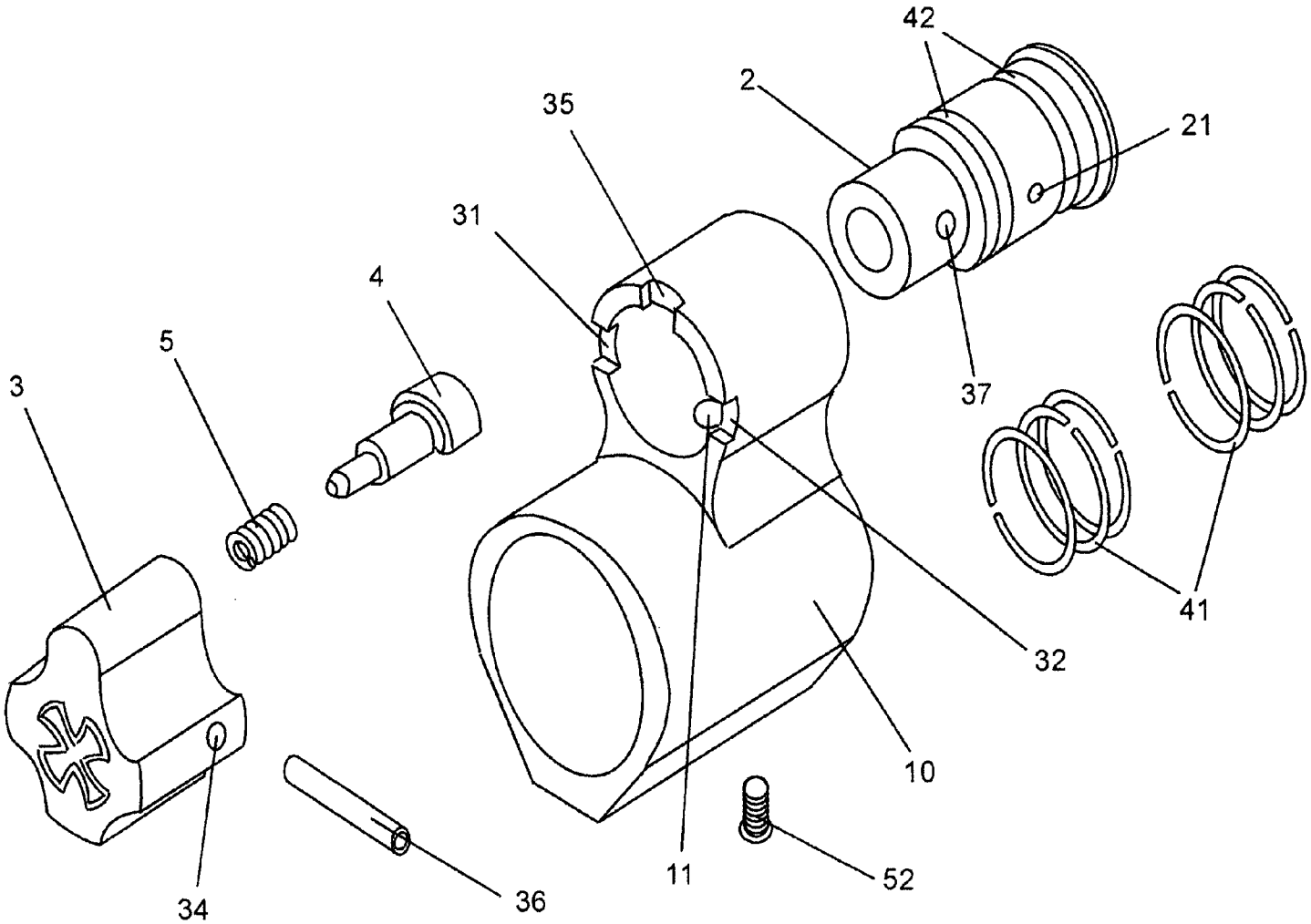
FIG. 3 is an exploded view thereof.

In FIGS. 2 & 3, there is illustrated a view of the Switchblock 1 and all of its components. The drum 2 has two openings 180 degrees apart consisting of a large gas port 20 and a smaller gas port 21. These two openings are 90 degrees offset from the roll pin retention point on the drum 2. A plurality of gas rings 41 are present on the drum 2 to each side of the gas ports 20 & 21. The adjustment detent 4, detent spring 5 and the adjustment knob 3 are also shown. The adjustment knob 3 has an opening 34 which is designed to contain the roll pin 36 that is used to secure the various components of the Switchblock 1. The housing 10 has three notches machined onto its outer surfaces. The notches are designed to interact with the detent 4. The notches serve as position one 31, position two 32, and the null position 35. The housing also has a gas port opening 11 which communicates with the gas system of the host firearm.

Figure 4:
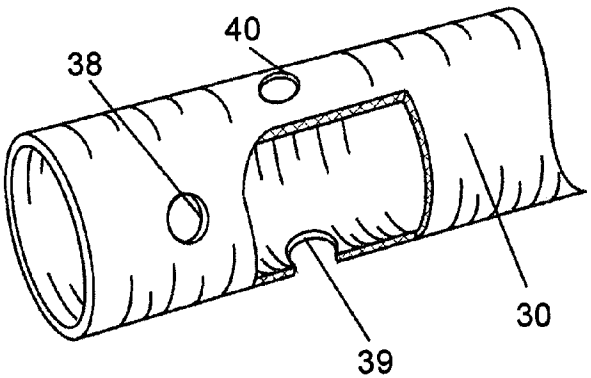
FIG. 4 is a side cutaway view of the preferred embodiment gas tube.

In FIG. 4, there is illustrated the gas tube 30 used with the preferred embodiment of the herein described device. The gas tube 30 has a retention point 38 which is used to secure the gas tube in the Switchblock 1. Also present are two gas tube openings, the large gas tube opening 39 is 180 degrees opposed to the small gas tube opening 40. The illustrated gas tube 30 is straight for its entire length.

Figure 5:
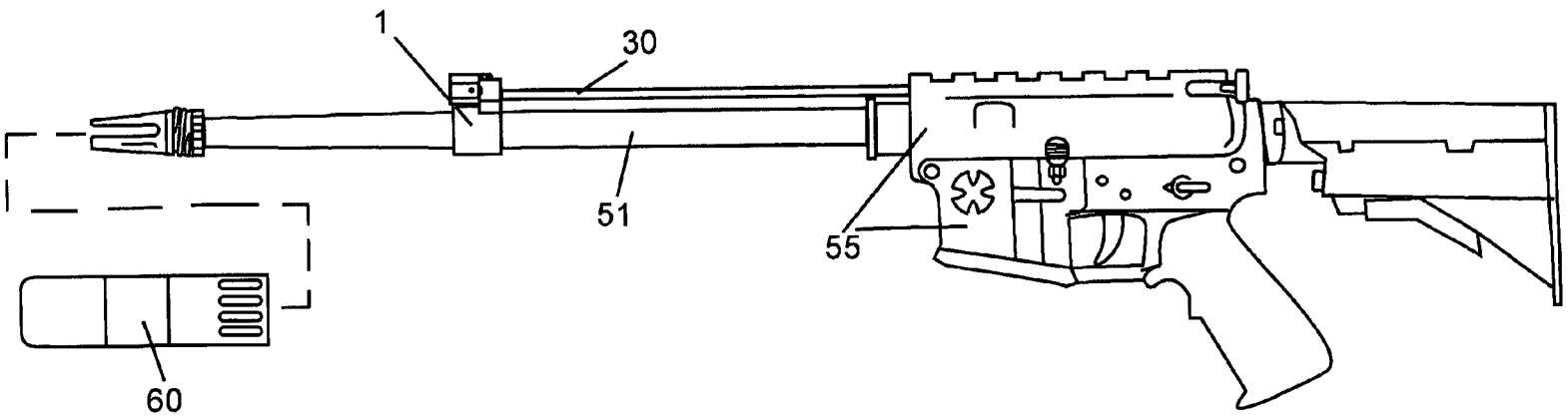
FIG. 5 is a side view of an autoloading rifle, Switchblock and silencer.

In FIG. 5, there is shown a firearm 50, consisting of a barrel 51, receivers 55, gas tube 30 and a Switchblock 1. A silencer 60 is also depicted.

Figure 6:
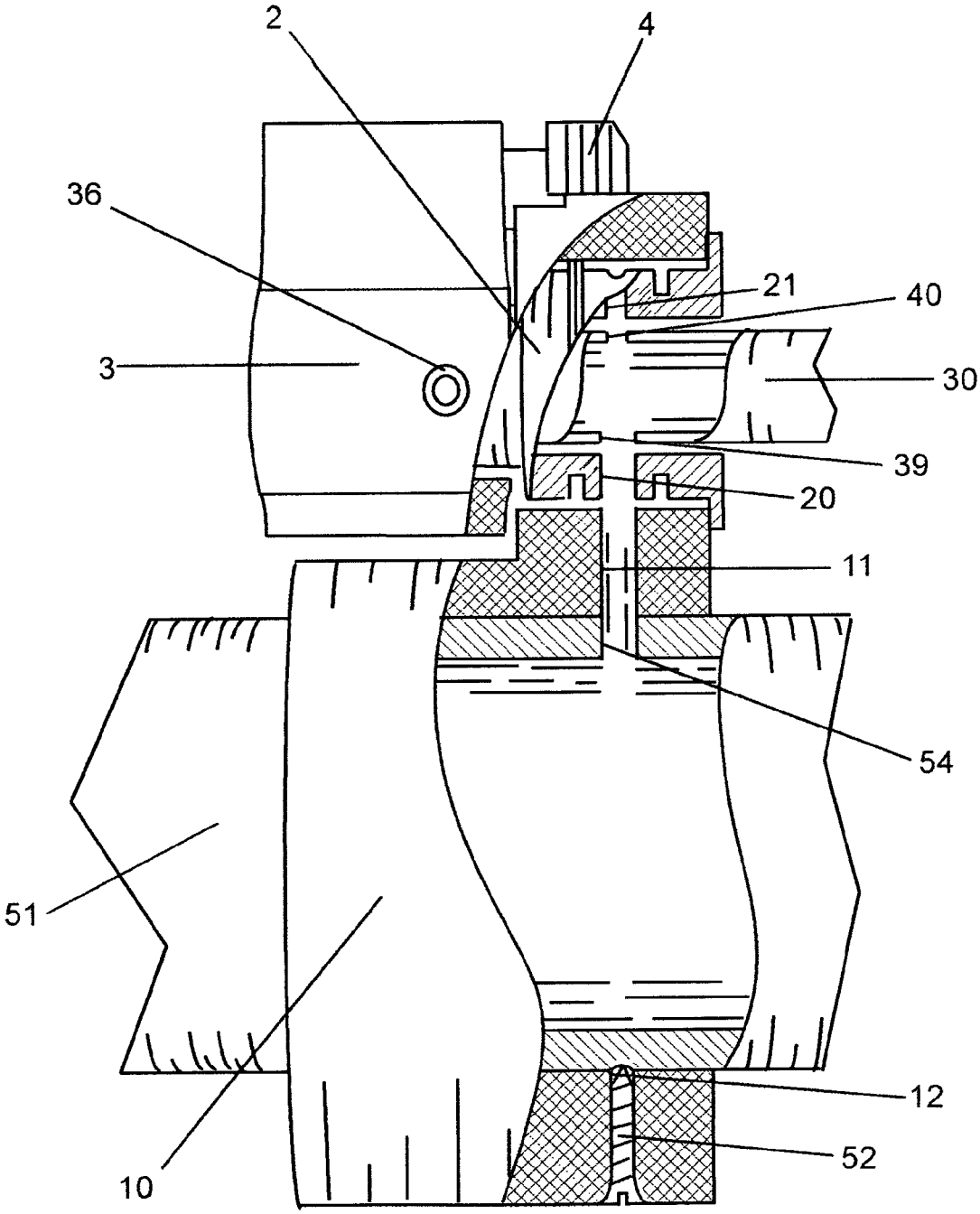
FIG. 6 is a side, cutaway view of the Switchblock and a firearm barrel.

In FIG. 6, there is shown a side, cutaway view of the Switchblock 1 mounted on a barrel 51. Of primary interest is how the gas port 54 of the barrel communicates with gas port opening 11 of the Switchblock 10. The amount of gas which is allowed to pass into the drum 2 is regulated by the orientation of gas port 1 20, gas port 2 21, or if the drum 2 is oriented in such a way as to prohibit the flow of gas. Also shown is a set screw 52 which will interface with a divot 53 on the barrel that serves as a retention point. The set screw 52 is threaded thru an opening in the gas block housing 10.

The Switchblock 1 must be machined to fit snugly around the diameter of the barrel 51 it is to be used with. Retention of the switch block 1 about the barrel 51 is achieved through the use of a single set screw 52 which are threadedly secured in one location 12 on the bottom of the switch block 1. One small divot 53 is machined into the barrel 51 for the above set screw 52 to rest in as a means to prevent rotational and longitudinal movement of the Switchblock 1 during normal operation.

The mounting location of the Switchblock 1 is selected so that the gas port 54 on the barrel 51 is positioned under the gas opening 11 located on the inside of the switch block 1. Once the switch block 1 is secured about the barrel 51 a gas tube 30 is inserted into the switch block 1 and secured in place by means of a roll pin 36.

The roll pin 36 is pushed through an opening 34 in the adjustment knob 3 which is aligned during assembly with an opening 37 in the drum 2 and gas tube retention point 38. The spring 5 which provides resistance for the adjustment detent 4 is housed within the adjustment knob 3. The detent 4 under pressure from a spring 5 presses against the gas block housing 10, thereby containing the two parts between the adjustment knob 3 and the drum 2. Position one 31, position two 32 and the null position 35 located of the gas block housing 10 will engage with the detent 4 and prevent rotation of the drum 2 and adjustment knob 3. Further the adjustment detent 4 and spring 5 are retained by the above assembly being secured with a roll pin 36.

As used herein, the word "front" or "forward" corresponds to direction left of the gas block housing (i.e., to the left as shown in FIGS. 1 & 3); "rear" or "rearward" or "back" corresponds to the direction opposite the direction of the gas block housing (i.e., to the right as shown in FIGS. 1 & 3); "longitudinal" means the direction along or parallel to the longitudinal axis a of the gas block housing; and "transverse" means a direction perpendicular to the longitudinal direction.

Gas flow from the barrel of a firearm 50 to its operating system is traditionally set at the factory based on the length of the barrel 51 present on the host firearm, and the distance of the gas port 54 from the receiver 55 of said firearm 50. The Switchblock 1 in position one 31 allows for the barrel gas port 54 to vent the factory proportion of gas into the gas tube 30. Position two 32 restricts the gas flow from the barrel gas port 54 into the gas tube 39. The diameter of gas port two 21 which is machined into the drum 2 for position two 32 is selected based on the use of a silencer 60, well known in the prior art, and the length of barrel 51 present on the host firearm 50. With a silencer 60 in place gas exiting the muzzle is severely restricted which increases the over all back pressure of gas within the host firearms 50 operating system. Back pressure forces more gas that is optimal into the gas operating system of the host firearm 50. By reducing the diameter of the hole which comprises gas port two 21 on the drum 2, the increased pressure generated by the use of a silencer does not affect the operation of the firearm 50. In effect, the gas operating system of the firearm 50 has the same volume of gas present as it would when the silencer 60 is no longer present.

Means for adjusting the gas block 1 from position one 31 to position two 32 and back is provided by an adjustment knob 3 which protrudes from the gas block 1. Also provided is a null position 35 where no gas is allowed to vent into the provided gas tube 39.

The gas tube 39 is inserted into a rotating drum 2 and held in place by means of a roll pin 36. This drum 2 rotates in a void located at the rear end of the gas block housing 10. The drum 2 has two sets of gas rings 41 located about its periphery to prevent the expanding gases from escaping the gas block housing 10. Flash and sound will be unnecessarily generated if gases are allowed to exit the gas block housing 10 around the drum 2. By placing the gas rings 41 before and after the gas port openings 20 & 21 located on the drum 2 expanding gases entering the Switchblock 1 will be contained within the gas block housing 10. There are located two openings 20 & 21 on the drum 2 for gas to pass; gas port one 31 has a larger opening than gas port two 32. These gas ports are 180 degree apart.

To rotate the drum 2 a locking detent 4 must be depressed which frees the drum 2 from restraint thus allowing for rotational adjustment. Once this detent 4 is depressed and the adjustment knob 3 is free from restraint, a 180 degree movement is all that is required to rotate the adjustment knob 3 and thereby the drum 2 between position one 31 and position two 32.

Between position one 31 and position two 32 is position null 35 which blocks the passage of propellant gases from the discharging firearm 50. The detent 4 described above will hold the rotating drum 2 in place once it has been adjusted to one of the three available positions of use.

CONCLUSION, RAMIFICATIONS, AND SCOPE

Accordingly the reader will see that I have provided a gas block for an autoloading firearm which is capable of restricting the flow of gas into the host firearm by restricting the flow of gas from the host firearms barrel. The gas block provided does not rely on venting excess gas into the atmosphere which will create undesirable flash and noise. A means of operation is afforded the user so that adjustment of the gas flow is quick and easy in field conditions. A gas tube with two apertures which control gas flow are provided by the factory or selected during the installation of the Switchblock. The user is afforded three positions which are quick and intuitive to select.

Another embodiment of the Switchblock could use taper pins to retain the gas block on the host firearm barrel in lieu of set screws.

Still another embodiment of the Switchblock could include two positions of use where a standard gas flow and a reduced gas flow for use with a silencer are all that is provided.

While my above drawings and description contain much specificity, these should not be construed as limitations on the scope of the invention, but rather as an exemplification of one preferred embodiment thereof.

Accordingly, the scope of the invention should be determined not by the embodiments illustrated, but by the appended claims and their legal equivalents."

The invention claimed is:

1. A firearm comprising:

a receiver;

a barrel connected to a front end of the receiver; and a gas block with means for securing the gas block onto the barrel, the gas block having a housing with a barrel receiving channel which has a portion of the barrel therein, the housing having an adjustment knob with means for rotating and retaining a drum within said housing, said drum having at least two openings and a periphery, said drum includes at least one gas ring on at least one end located about the periphery of the drum to create a seal between the drum and the housing, a gas tube extending between the receiver and the gas block, said gas tube having means to communicate with said drum, wherein the gas block has an opening which communicates with a barrel gas port.

2. A firearm as in claim 1 wherein said gas block is made from metal and includes at least one set screw for retention onto said barrel.

3. A firearm as in claim 1 wherein said openings on said drum number two, and said openings are 180 degrees opposed.

4. A firearm as in claim 3 wherein the barrel gas port is located so the barrel gas port cooperates with the opening in said gas block to allow said gas tube to communicate with the barrel.

5. In a gas operated firearm having a receiver, a stock connected to an end of the receiver, a barrel connected to a front of the receiver, a handguard connected to the barrel and a gas tube extending into the receiver, wherein the improvement comprises:

a gas block with means to secure onto the barrel, the gas block having a housing with a barrel receiving channel which has a portion of the barrel therein;

said housing having an adjustment knob which includes a spring loaded detent to prevent said adjustment knob from rotating;

a drum in operational communication with said adjustment knob, which facilitates the rotation of said drum into a plurality of pre set positions wherein at least one position is provided to work with a silencer and another position completely blocks a flow of gas from said firearm barrel into the drum and the gas tube;

said drum having at least two openings of different sizes located 180 degrees apart, and at least one gas ring on at least one end of said drum; and said gas tube extending between the receiver and the gas block, said gas tube having means to communicate with the at least two openings of the drum.

6. A firearm as in claim 5, wherein the gas block has a porthole communicating with the gas tube, the porthole being located so that the gas tube is connected to the barrel.

7. A firearm comprising:

a receiver;

a barrel connected to a front end of the receiver;

a gas block attached onto the barrel;

the gas block closely receiving a portion of the barrel therein;

the barrel including a gas port;

the housing including a gas port opening in communication with the gas port of the barrel;

the housing receiving a drum therein;

the housing including an adjustment knob that rotates and retains the drum within the housing;

the drum including at least one gas ring on at least one end to create a seal between the drum and the housing;

the drum having at least two openings;

the adjustment knob having an indexing feature to locate the drum in a plurality of predefined positions;

wherein two of the plurality of predefined positions locate each of the two openings of the drum in communication with the gas port opening of the housing; and a gas tube extending between the receiver and the gas block, the gas tube enabling communication between the drum and the receiver.

8. The firearm of claim 7, wherein the plurality of predefined positions include at least one position that completely blocks gas from flowing from the gas port opening of the housing into the drum and the gas tube.

9. The firearm of claim 7, wherein the at least two openings of the drum have different diameters.

10. The firearm of claim 7, wherein at least one of the at least two openings of the drum has a diameter permitting flow of a volume of gas that is the optimal amount of gas necessary to properly operate the firearm without a back pressure inducing device being attached to the barrel.

11. The firearm of claim 7, wherein at least one of the at least two openings of the drum has a reduced diameter permitting flow of a volume of gas that is the optimal amount of gas necessary to properly operate the firearm with a back pressure inducing device being attached to the barrel.

12. The firearm of claim 11, wherein the back pressure inducing device is a silencer.

13. The firearm of claim 11, wherein the volume of gas permitted to flow through the reduced diameter opening of the drum is substantially equivalent to the volume of gas necessary to properly operate the firearm without a back pressure inducing device being attached to the barrel.

14. The firearm of claim 7, wherein the at least one gas ring prevents gas from exiting the gas block housing around the drum.

* * * * *